US011754976B2

(12) United States Patent
Stranczl

(10) Patent No.: US 11,754,976 B2
(45) Date of Patent: Sep. 12, 2023

(54) SUSPENDED-HAMMER TIMEPIECE STRIKING MECHANISM

(71) Applicant: Montres Breguet S.A., L'Abbaye (CH)

(72) Inventor: Marc Stranczl, Nyon (CH)

(73) Assignee: Montres Breguet S.A., L'Abbaye (CH)

( * ) Notice: Subject to any disclaimer, the term of this patent is extended or adjusted under 35 U.S.C. 154(b) by 952 days.

(21) Appl. No.: 16/683,554

(22) Filed: Nov. 14, 2019

(65) Prior Publication Data

US 2020/0183333 A1 Jun. 11, 2020

(30) Foreign Application Priority Data

Dec. 6, 2018 (EP) ..... 18210745

(51) Int. Cl.
*G04B 21/06* (2006.01)
*G04B 21/08* (2006.01)

(52) U.S. Cl.
CPC ..... *G04B 21/06* (2013.01); *G04B 21/08* (2013.01)

(58) Field of Classification Search
CPC ..... G04B 21/06; G04B 21/08
See application file for complete search history.

(56) References Cited

U.S. PATENT DOCUMENTS

2011/0158058 A1* 6/2011 Marechal ..... G04B 21/12 368/243
2012/0147715 A1* 6/2012 Karapatis ..... G04B 23/028 368/267
2012/0155227 A1* 6/2012 Karapatis ..... G04B 23/026 368/243

(Continued)

FOREIGN PATENT DOCUMENTS

CH 701200 A2 12/2010
CH 706468 A2 * 11/2013 ..... G04B 21/10

(Continued)

OTHER PUBLICATIONS

Communication dated Dec. 23, 2020 from the China National Intellectual Property Administration in CN Application No. 201911241846.3.
European Search Report for EP 18 21 0745 dated Jul. 2, 2019.
Notice of Reasons for Refusal dated Dec. 15, 2020 from the Japanese Patent Office in Application No. 2019-216208.

*Primary Examiner* — Edwin A. Leon
*Assistant Examiner* — Kevin Andrew Johnston
(74) *Attorney, Agent, or Firm* — Sughrue Mion, PLLC

(57) ABSTRACT

Timepiece striking mechanism, including a fixed structure supporting at least one gong or radiant element and a mobile hammer in a plane under the action of an activation mobile component controlling the pallet of the hammer (3) and the release thereof for the percussion of the gong, and including, for the suspension of the hammer, at least one planar flexible guide between the structure and the hammer (3) to allow movements of the hammer solely on the plane, forming the sole mechanical link between the structure and the hammer, and, more particularly, for the execution of a striking mechanism, the striking mechanism (drives the activation mobile component, and has same carry out a winding cycle during which it supplies constant quantity of energy to the flexible guide while driving the hammer before releasing same for the execution of the striking mechanism by percussion of the gong during letting down.

20 Claims, 5 Drawing Sheets

(56) References Cited

U.S. PATENT DOCUMENTS

| | | | | |
|---|---|---|---|---|
| 2012/0195174 | A1* | 8/2012 | Goeller | G04B 23/12 368/243 |
| 2012/0201105 | A1* | 8/2012 | Chatelain | G04B 23/026 368/243 |
| 2014/0104994 | A1* | 4/2014 | Raggi | G04B 23/028 368/243 |
| 2016/0299472 | A1* | 10/2016 | Legeret | G04B 23/023 |

FOREIGN PATENT DOCUMENTS

| | | | |
|---|---|---|---|
| CH | 706 468 | B1 | 8/2016 |
| CN | 101441435 | A | 5/2009 |
| CN | 102053556 | A | 5/2011 |
| CN | 102169324 | A | 8/2011 |
| CN | 105911845 | A | 8/2016 |
| EP | 0451340 | A1 | 10/1991 |
| EP | 3 483 666 | A1 | 5/2019 |
| JP | 2004-525370 | A | 8/2004 |
| JP | 2011-47945 | A | 3/2011 |
| JP | 2012-159504 | A | 8/2012 |
| JP | 2016-176933 | A | 10/2016 |
| JP | 2016-200592 | A | 12/2016 |
| WO | 2012010408 | A1 | 1/2012 |
| WO | 2018193365 | A1 | 10/2018 |

* cited by examiner

SUSPENDED-HAMMER TIMEPIECE STRIKING MECHANISM

CROSS-REFERENCE TO RELATED APPLICATIONS

This application claims priority to European Patent Application No. 18210745.8, filed on Dec. 6, 2018, the entire contents of which are incorporated herein by reference.

FIELD OF THE INVENTION

The invention relates to a timepiece striking mechanism, comprising a fixed structure supporting at least one gong or radiant element and a mobile hammer in a plane relative to said fixed structure under the action of an activation mobile component, comprised by said mechanism, and which is arranged to control the pallet of said hammer and the release thereof for the percussion of at least one said gong or radiant element.

The invention further relates to a watch comprising energy storage and/or generation means, and a timepiece movement, which are arranged to drive such a striking mechanism.

The invention relates to the field of timepiece striking or alarm mechanisms.

BACKGROUND OF THE INVENTION

The invention relates to striking and alarm mechanisms, and in particular the system for actuating the hammers comprised by these mechanisms.

Gong activation mechanisms of conventional design, which typically comprise a pallet assembly or a pallet which activates a hammer, which in turn strikes a gong or radiant element, are often limited, and in particular irregular.

In particular, the sound intensity of the striking mechanism varies during the energy reserve of the mechanism.

And the sound quality is not always optimal, and needs to be enhanced, by an optimisation of the percussion quality.

SUMMARY OF THE INVENTION

The invention proposes to enhance percussion quality and regularity in a striking or alarm mechanism.

For this purpose, the invention relates to a timepiece striking mechanism, according to claim 1.

The invention further relates to a watch comprising energy storage and/or generation means, and a timepiece movement, which are arranged to drive such a striking mechanism.

BRIEF DESCRIPTION OF THE DRAWINGS

Further features and advantages of the invention will emerge on reading the following detailed description, with reference to the appended drawings, where:

FIG. 2 illustrates an activation mobile component, herein an activation wheel, winding the hammer, that it drives by a beak;

FIG. 3 shows the fully wound hammer, the flexible strip which connects same to the plate is curved according to a first concavity;

FIG. 4 shows the hammer during the percussion travel thereof towards a gong, the flexible guide thereof cooperates by abutting on a fixed banking rigidly connected to the plate, and the distal end of the flexible guide, which supports the hammer, adopts a second concavity opposite the first concavity and pushes the hammer in the manner of a toggle to strike the gong;

FIG. 6 represents, similarly to FIG. 1, a further striking mechanism, according to a design based on the four-bar mechanism, and comprising a hammer mounted on a multiple flexible guide, comprising a first flexible guide on the activation mobile component, and a second flexible guide on the side of a striker comprised by the hammer to strike the gong, and wherein

FIG. 7 illustrates the status of the system immediately after impact;

FIG. 8 shows the system at rest;

FIG. 9 shows the maximum winding position of the hammer;

FIG. 10 shows the hammer during the impact on the gong;

DETAILED DESCRIPTION OF PREFERRED EMBODIMENTS

The invention relates to striking and alarm mechanisms, and more particularly the hammer actuation system.

Figure 1:
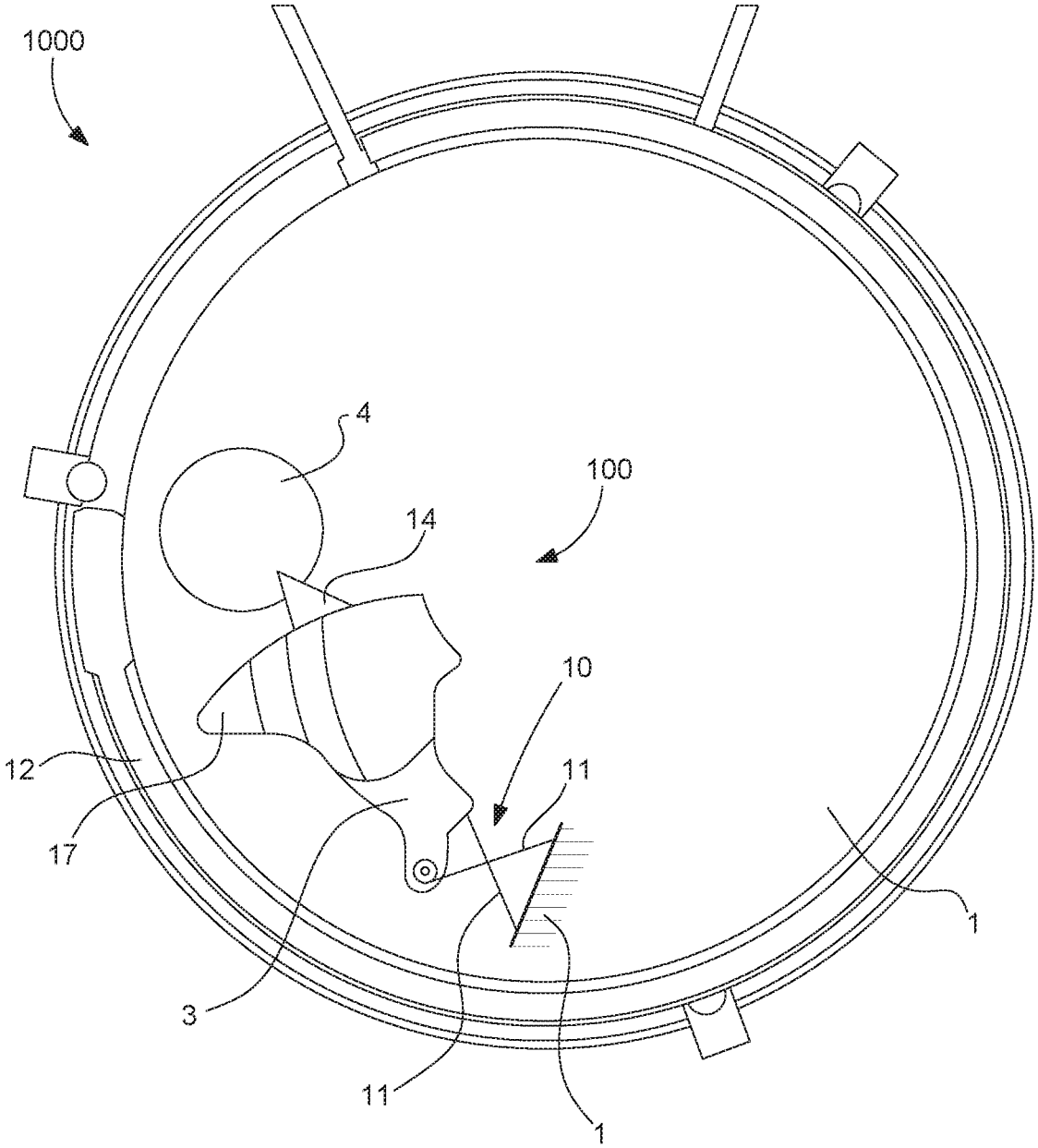
FIG. 1 represents, in a schematic, partial view, and in a plane view, a striking mechanism comprising a hammer mounted on a flexible guide with projecting crossed strips.

The invention proposes to use flexible guides for the guidance and return of the gong hammer. The most basic mechanism is represented schematically in FIG. 1, which shows a hammer suspended by at least a flexible guide, herein represented in a non-limiting manner in the form of a flexible guide with two projecting crossed elastic strips, guiding same in a substantially planar travel. The mechanism in FIG. 1 works as follows: an activation mobile component, particularly an activation wheel, or indeed a pallet, lifts the hammer, and moves same from the rest position thereof to perform winding, until the tooth comprised by the hammer no longer engages with the wheel in the example illustrated. The hammer then falls, under the action of the energy contained in the spring, during letting down, and strikes the gong or radiant element. The activation wheel engages the hammer once again, and the operation is repeated in the same way.

The rest position of the hammer remains to be defined. It would appear that a rest position of the hammer very close to the impact position is preferable. A solution with a prestressed hammer can also be envisaged. Prestressing makes it possible to adjust the energy stored in the hammer. The advantage of the presence of a flexible guide has the advantage of positioning the hammer precisely, and particularly of having no play. This makes it possible to eliminate the usual parasitic noise caused in existing striking mechanisms by the play of the mechanical pivot of the hammer. The flexible guide accurately defines the energy stored in the hammer. The system is therefore capable of supplying the same quantity of energy upon each percussion. A further advantage may be observed at the end of striking, when the activation wheel can no longer lift the hammer, but applies a low torque, which prevents the hammer from touching the gong or radiant element, and therefore prevents triggering involuntary strikes on the gong, of the rebound or similar type.

It is understood that the combined system formed of a hammer and a flexible guide forms a resonator, which is then suitable for use for regulating the striking mechanism.

Figure 2:
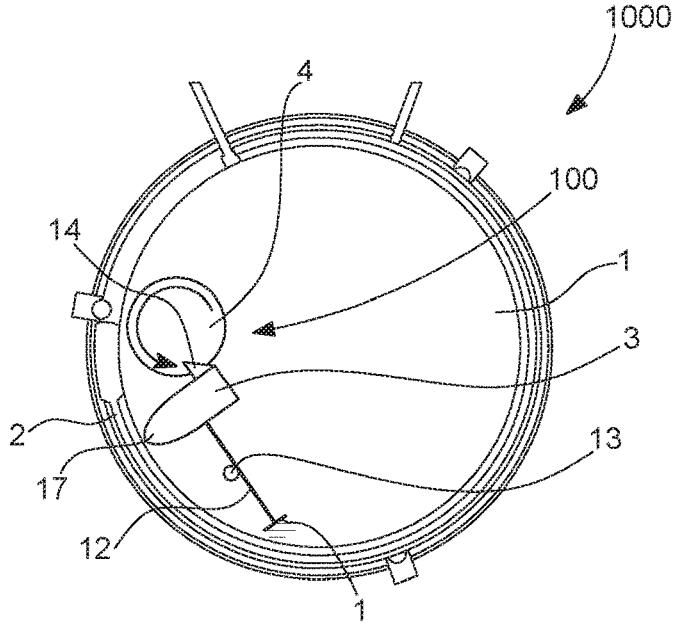
FIGS. 2 to 4 represent, similarly to FIG. 1, a mechanism with such a hammer on a further flexible guide of the elastic or similar type, with variable rigidity/dynamics.
Figure 3:
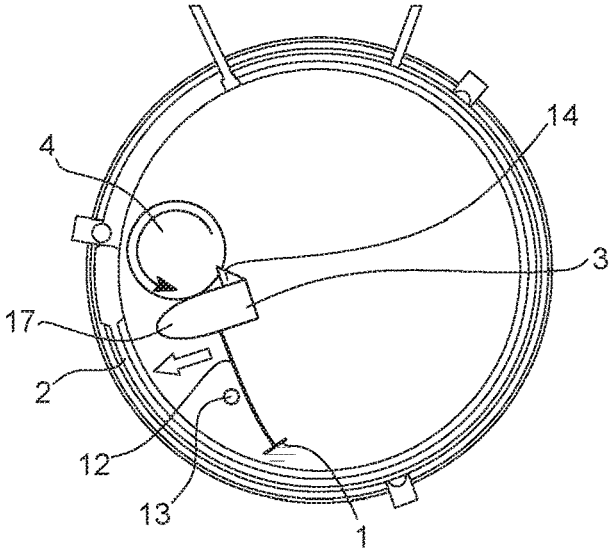
Figure 4:
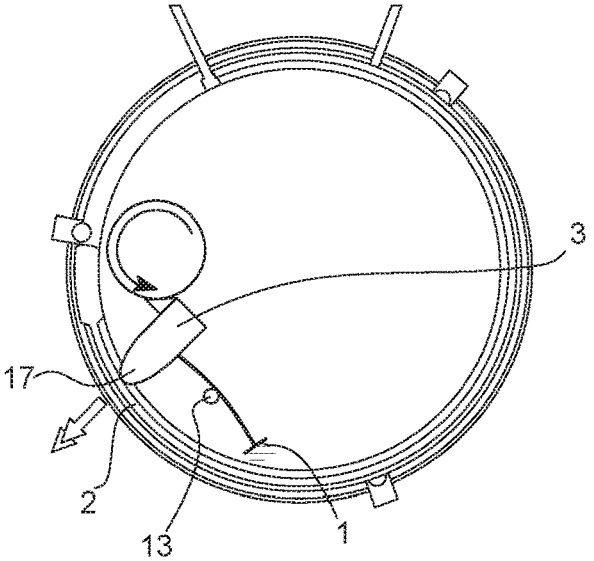

FIGS. 2 to 4 illustrate an alternative embodiment which consists of modifying the dynamic rigidity of the flexible guide, by inserting an obstacle on the path of at least one strip comprised by this flexible guide, in the operating range thereof. FIG. 2 illustrates an intermediate position of the winding of the hammer, FIG. 3 shows the position where the hammer is fully wound, and FIG. 4 illustrates the detent and the start of the travel of the hammer towards the percussion position thereof, immediately before the impact the flexible guide abuts against a pin, or a further fixed obstacle, prior to the contact of the hammer against the gong or radiant element. At the limit, this cooperation of banking may take place at the very moment of impact. The rigidity of the mechanism in the position in FIG. 3 is lower than in the position in FIG. 4, as the active length of the strip, from the recess on the side of the plate to the hammer is greater in FIG. 3 than in FIG. 4; obviously, in the position in FIG. 4, the entire strip is deformed, but it is more rigid therein than in FIG. 3. This principle is comparable to that of a catapult, or of the Neolithic propeller.

Figure 5:
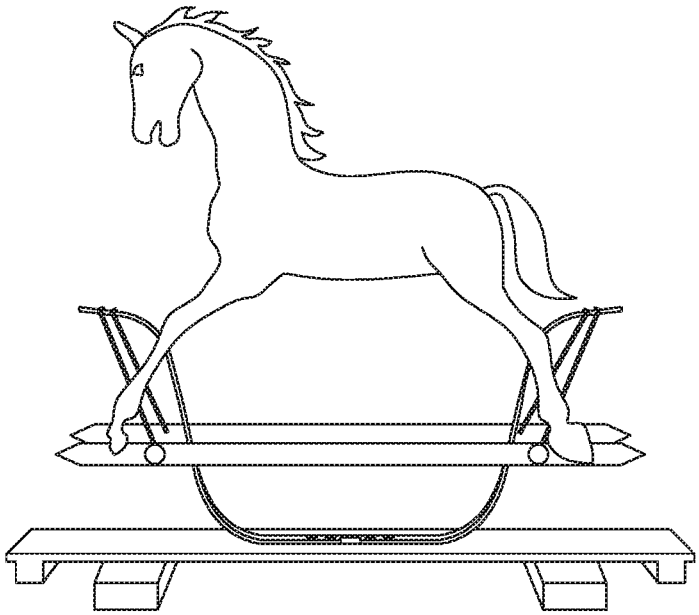
FIG. 5 illustrates, in a schematic elevation view, a rocking horse using a four-bar mechanism.

An alternative embodiment of the invention is based on the principle, illustrated by FIG. 5 of the operation of wooden rocking horses. This mechanism is known as the "four-bar mechanism". It is interesting as the horse normally rocks at low amplitude, and bucks at high amplitude. By transposing this system by replacing the horse by a hammer, the latter may be accelerated, in the manner of the bucking of the horse, immediately prior to the impact against the gong or radiant element. Despite the apparent simplicity of the mechanism, the design is relatively complex. There are a multitude of solutions and possibilities. The paths of the guided elements and the speeds of the mobile components may be defined according to the embodiment sought.

Figure 6:
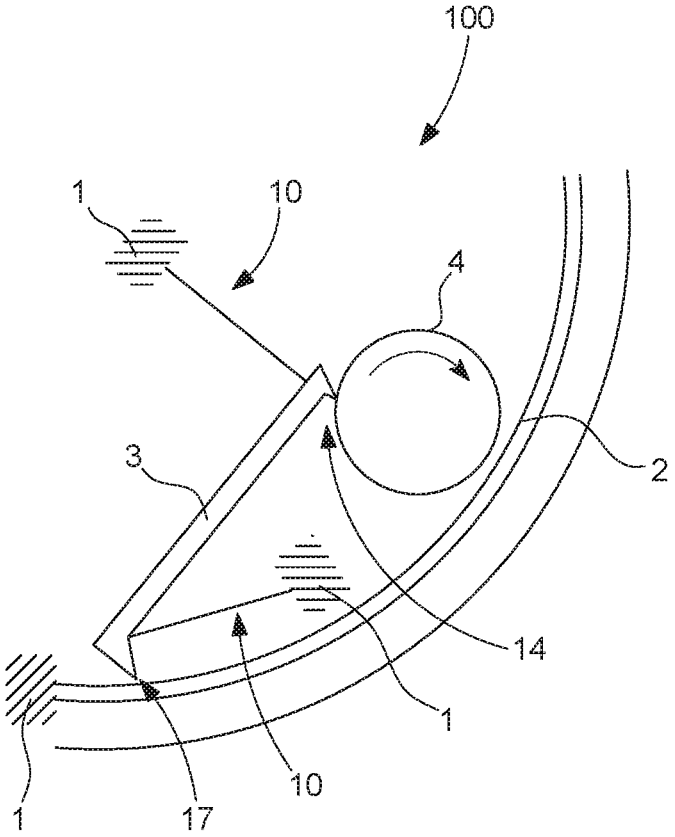
Figure 7:
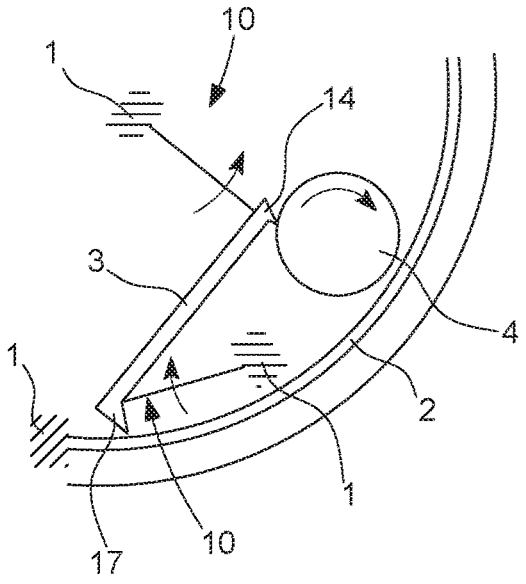
FIGS. 7 to 10 illustrate the operating sequence.
Figure 8:
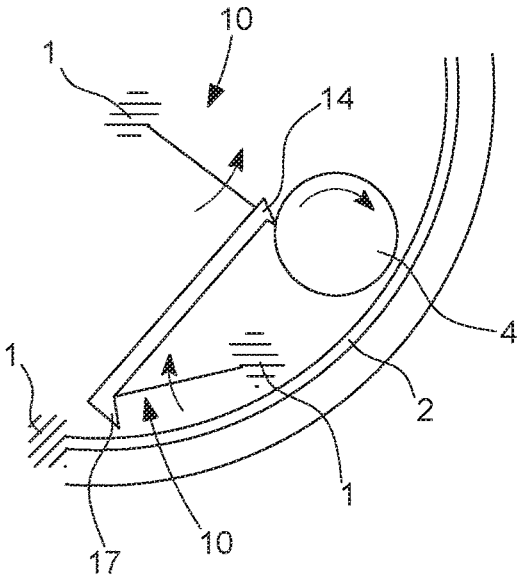
Figure 9:
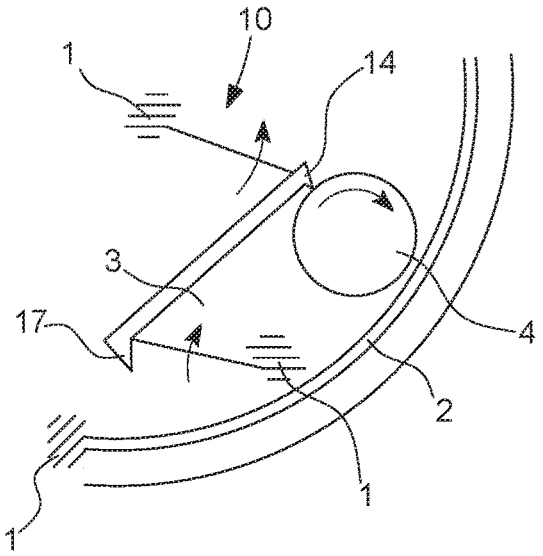
Figure 10:
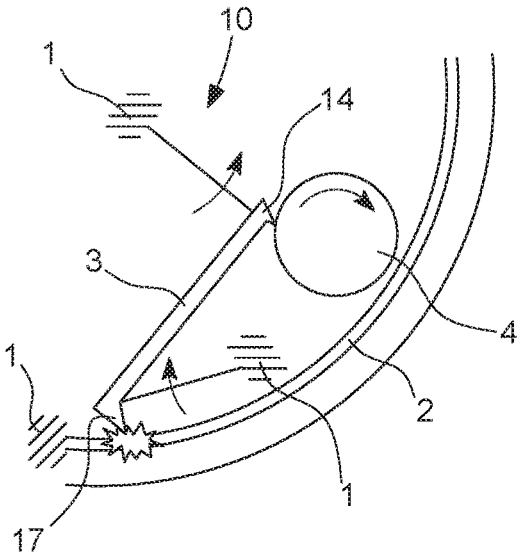
Figure 13:
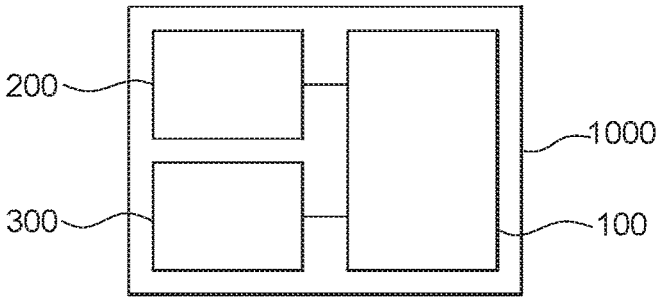
FIG. 13 is a block diagram representing a watch comprising energy storage and/or generation means, and a timepiece movement, which are arranged to drive such a striking mechanism.

For watchmaking, the four-bar pivoting or hinge points are replaced by flexible guides. A further solution is that of replacing a complete bar by a flexible strip. An example of design is presented in FIG. 6, and the various operating sequences are described in FIGS. 7 to 10.

Advantageously, the four-bar system, or other equivalent flexible guide, is designed so as to accelerate the hammer immediately before striking. This is one of the main advantages of this mechanism.

It is also possible to add a banking, such as a pin or similar, which modifies the rigidity/dynamics of the flexible guide on the system in FIGS. 7 to 10, according to the principle shown in FIG. 4.

Figure 11:
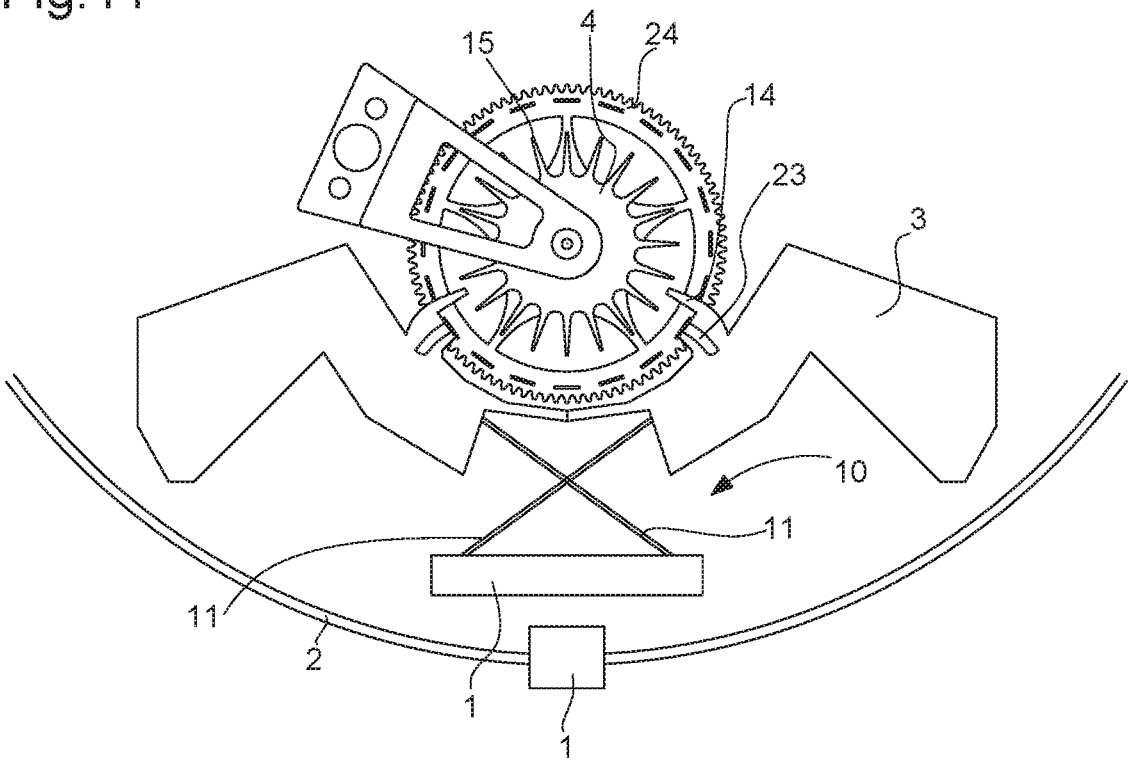
FIG. 11 illustrates an alternative embodiment of the invention with a magnetic type escapement mechanism according to the application CH01421/16 or the application EP16195405.2 held by The Swatch Group Research & Development Ltd, and comprises a hammer on a flexible guide, with projecting crossed strips, and supporting magnets arranged to cooperate with other magnets borne by an escapement wheel.

A further alternative embodiment of the invention is based on a magnetic type escapement mechanism according to the application CH01421/16 or the application EP16195405.2 held by The Swatch Group Research & Development Ltd, and comprises a hammer on a flexible guide, with projecting crossed strips, and supporting magnets arranged to cooperate with further magnets borne by an escapement wheel. This alternative embodiment is very simple, it is simply necessary to transpose the teachings of this escapement mechanism for the activation of a striking mechanism hammer instead of the resonator as illustrated in FIG. 11.

Figure 12:
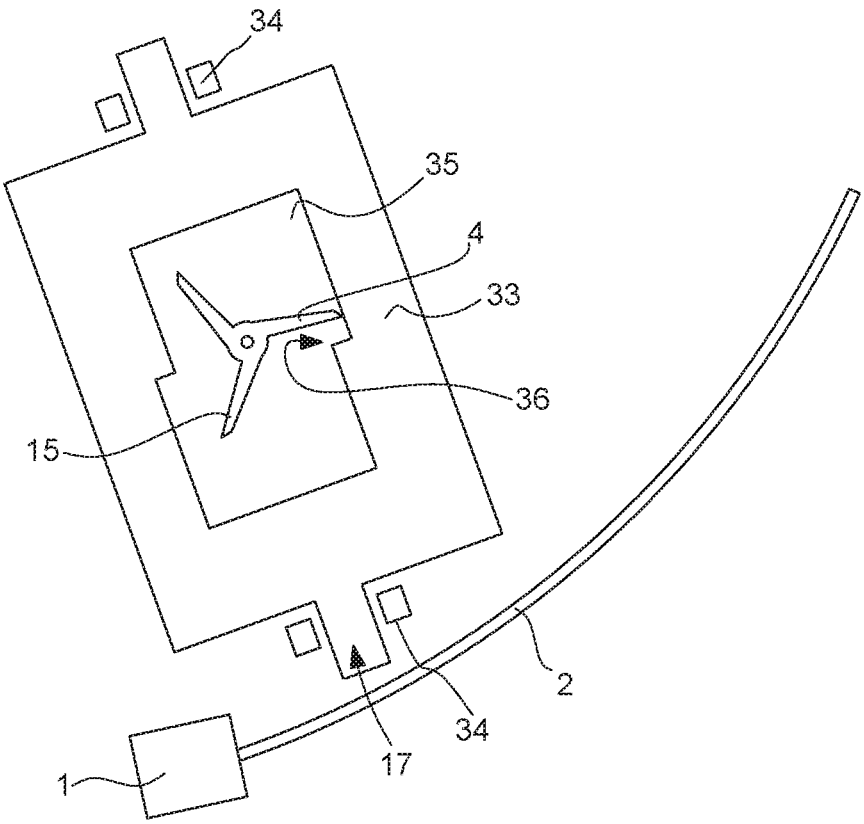
FIG. 12 represents, similarly to FIG. 1, a further striking mechanism, in an alternative embodiment of activation with a hammer on linear guide.

FIG. 12 illustrates a further alternative embodiment which uses a linear flexible guide to activate the hammer, with an activation wheel cooperating with raised sections of a mobile frame, as described particularly in the patent EP2831677B1 held by Nivarox-FAR SA, relating to a mobile frame escapement mechanism. This mechanism makes it possible to perform linear percussion instead of angular percussion, which may be advantageous for size reasons.

It is also possible to activate the hammer by placing a pin (on the activation wheel) which slides in an oblong hole in the hammer. It should be noted that, in this case, the dynamics of the hammer are modified, as they are linked with the dynamics of the train.

The flexible guides make it possible to carry out a multitude of movements. It is particularly possible to carry out virtual pivoting of the hammer.

More particularly, the invention thus relates to a timepiece striking mechanism 100, comprising a fixed structure 1 supporting at least one gong or radiant element 2 and a mobile hammer 3 relative to the fixed structure 1 under the action of an activation mobile component 4, comprised by said mechanism 100. This activation mobile component 4 is arranged to control the pallet of said hammer 3 and the release thereof for the percussion of at least one gong or radiant element 2.

According to the invention, the striking mechanism 100 comprises, for the suspension of the hammer 3, at least one flexible guide 10, which is arranged between the fixed structure 1 and the hammer 3 to allow movements of the hammer 3, and which forms the sole permanent mechanical link between the fixed structure 1 and the hammer 3. In the non-limiting particular alternative embodiment illustrated by the figures, the mechanism 100 comprises planar type flexible guides 10.

More particularly, the striking mechanism 100 is arranged to drive the activation mobile component 4, for the execution of a striking mechanism, and to have same carry out a winding cycle during which it supplies a certain quantity of energy to the flexible guide 10 in question (which stores a constant quantity of energy) while driving the hammer 3, before releasing the hammer 3 for the execution of the striking mechanism by percussion of at least one gong or radiant element 2 by the hammer 3 during the letting down with a constant quantity of energy corresponding to the energy stored in this flexible guide 10.

In a particular embodiment, at least one flexible guide 10 is planar, and is arranged between the fixed structure 1 and the hammer 3 to allow movements of the hammer 3 solely in a single plane P.

In a particular embodiment, the hammer 3 is mobile in such a plane P, and at least one flexible guide 10 is of the planar type and comprises a plurality of elastic strips 11 which extend in the plane P or in a plurality of planes parallel with the plane P, and which are, either parallel with one another, or indeed crossed in projection on the plane P at the level of a virtual pivoting axis D.

In a particular alternative embodiment, at least one flexible guide 10 comprises at least one bistable or multistable elastic strip.

In an alternative embodiment, the striking mechanism comprises at least one flexible guide 10 which is arranged to guide the hammer 3 in the winding and letting down travels thereof in a plane P, and to accelerate the hammer 3 at the end of letting down travel.

More particularly at least one flexible guide 10 comprises at least one first elastic strip arranged to guide the hammer 3 in the winding and letting down travels thereof in a plane P, and at least one second elastic strip arranged to accelerate the hammer 3 at the end of letting down travel.

In a particular embodiment, at least one of the flexible guides 10 comprises a reinforced strip 12, which is arranged to cooperate, particularly in the median part thereof, by abutting, during the letting down travel and before the percussion of the hammer 3 against a gong or radiant element 2, with a fixed banking 13 rigidly connected to the fixed structure 1, so as to accelerate the hammer 3 immediately before the impact thereof on the gong or radiant element 2.

In an alternative embodiment, the hammer 3 comprises a first winding tooth 14 arranged to cooperate with an activation tooth 15 comprised by the activation mobile component 4 during the winding phase for pivoting the hammer 3, and the hammer 3 comprises, at a distance from the first winding tooth 14, a striker 17 arranged to strike a gong or radiant element 2, and the striking mechanism 100 comprises a flexible guide 10 in the vicinity of the first winding tooth 14 and in the vicinity of the striker 17.

More particularly, the hammer 3 comprises a first winding tooth 14 arranged to cooperate with an activation tooth 15 comprised by the activation mobile component 4 during the winding phase for pivoting the hammer 3, and the flexible guide 10 comprises a first elastic strip in the vicinity of the first winding tooth 14, and the hammer 3 comprises, at a distance from the first winding tooth 14, a striker 17 arranged to strike a gong or radiant element 2, and the flexible guide 10 comprises at least a second elastic strip in the vicinity of the striker 17.

In a further alternative embodiment, the striking mechanism 100 comprises a striking mechanism barrel and/or a energy storage and distribution means, and the hammer 3 comprises a first winding tooth 14 arranged to cooperate with an activation tooth 15 comprised by the activation mobile component 4 during the winding phase for pivoting the hammer 3, and a second anti-unhooking tooth 16 arranged to be inserted, at the end of winding and at least the start of letting down, between two further activation teeth 15, so as to prevent any uncontrolled unwinding of said striking mechanism barrel and/or energy storage and distribution means.

In a magnetic alternative embodiment, the hammer 3 comprises at least one hammer magnet 23 or a ferromagnetic hammer element, arranged to cooperate with a ferromagnetic element of a mobile component or a magnet 24 of a mobile component, for the driving and release of the hammer 3 by the activation mobile component 4.

In an embodiment, the hammer 3 is moved by a substantially rotary movement or a combination of rotary movements.

In a further embodiment, the hammer 3 is moved by a longitudinal movement. More particularly, the hammer 3 comprises a mobile frame 33 guided longitudinally in bearing blocks 34, the frame 33 comprising internally a chamber 35 wherein rest beaks 36 are arranged to cooperate with activation teeth 15 comprised by the activation mobile component 4.

In a particular embodiment, the hammer 3 and the flexible guide(s) 10 supporting same, as well as the gong or radiant element 2 with which the hammer 3 cooperates, are, in projection along the plane P, symmetrical with respect to a plane perpendicular to the plane P.

In an alternative embodiment, the striking mechanism 100 comprises, for the suspension of the hammer 3, a plurality of planar flexible guides 10, separate and at a distance from one another.

In an alternative embodiment, the striking mechanism 100 comprises a plurality of hammers 3 and a plurality of gongs or radiant elements 2.

In an alternative embodiment, the hammer 3 and one of the flexible guides 10 supporting same form together a resonator arranged to regulate the striking mechanism.

The invention further relates to a watch 1000 comprising energy storage and/or generation means 200 and a timepiece movement 300 arranged to drive a striking mechanism 100.

The invention offers numerous advantages:

- the prestressing of the hammer spring enables constant striking mechanism intensity;
- the appropriate design of a four-bar type mechanism makes it possible to accelerate the hammer during striking;
- the sound quality of the striking mechanism is enhanced.

The invention claimed is:

1. A timepiece striking mechanism (100), comprising a fixed structure (1) supporting at least one gong or radiant element (2) and a mobile hammer (3) relative to said fixed structure (1) under the action of an activation mobile component (4), comprised by said mechanism (100), and which is arranged to control the pallet of said hammer (3) and the release thereof for the percussion of at least one said gong or radiant element (2), wherein said striking mechanism (100) comprises, for the suspension of the hammer (3), at least one flexible guide (10), which is arranged between the fixed structure (1) and the hammer (3) to allow movements of the hammer (3), and which forms the sole permanent mechanical link between said fixed structure (1) and said hammer (3).

2. The timepiece striking mechanism (100) according to claim 1, wherein said striking mechanism (100) is arranged to drive said activation mobile component (4), for the execution of a striking mechanism, and to have the activation mobile carry out a winding cycle during which it supplies energy to said at least one flexible guide (10), which stores a constant quantity of energy, while driving said hammer (3) before releasing said hammer (3) for the execution of the striking mechanism by percussion of at least one said gong or radiant element (2) by said hammer (3) during the letting down with a constant quantity of energy corresponding to the energy stored in said flexible guide (10).

3. The timepiece striking mechanism (100) according to claim 1, wherein said at least one flexible guide (10) is planar, and is arranged between said fixed structure (1) and said hammer (3) to allow movements of said hammer (3) solely in a single plane (P).

4. The timepiece striking mechanism (100) according to claim 3, wherein said at least said flexible guide (10) comprises a plurality of elastic strips (11) which extend in said plane (P) or in a plurality of planes parallel with said plane (P), and which are, either parallel with one another, or crossed in projection on said plane (P) at the level of a virtual pivoting axis (D).

5. The timepiece striking mechanism (100) according to claim 1, wherein said at least one said flexible guide (10) comprises at least one bistable or multistable elastic strip.

6. The timepiece striking mechanism (100) according to claim 1, wherein said striking mechanism (100) comprises at least one said flexible guide (10) which is arranged to guide said hammer (3) in the winding and letting down travels thereof in a plane (P), and to accelerate said hammer (3) at the end of letting down travel.

7. The timepiece striking mechanism (100) according to claim 1, wherein said at least one said flexible guide (10) comprises at least one first elastic strip arranged to guide said hammer (3) in the winding and letting down travels thereof in a plane (P), and at least one second elastic strip arranged to accelerate the hammer (3) at the end of letting down travel.

8. The timepiece striking mechanism (100) according to claim 1, wherein said at least one of said flexible guides (10) comprises a reinforced strip (12) which is arranged to cooperate, particularly in the median part thereof, by abutting, during the letting down travel and before the percussion of said hammer (3) against a said gong or radiant element (2), with a fixed banking (13) rigidly connected to said fixed structure (1), so as to accelerate said hammer (3) immediately before the impact thereof on said gong or radiant element (2).

9. The timepiece striking mechanism (100) according to claim 1, wherein said hammer (3) comprises a first winding tooth (14) arranged to cooperate with an activation tooth (15) comprised by said activation mobile component (4) during the winding phase for pivoting said hammer (3), and wherein said hammer (3) comprises, at a distance from said first winding tooth (14), a striker (17) arranged to strike said gong or radiant element (2), and wherein said striking mechanism (100) comprises a said flexible guide (10) in the vicinity of said first winding tooth (14) and in the vicinity of said striker (17).

10. The timepiece striking mechanism (100) according to claim 1, wherein said hammer (3) comprises a first winding tooth (14) arranged to cooperate with an activation tooth (15) comprised by said activation mobile component (4) during the winding phase for pivoting said hammer (3), and wherein said flexible guide (10) comprises at least a first elastic strip in the vicinity of said first winding tooth (14), and wherein said hammer (3) comprises, at a distance from said first winding tooth (14), a striker (17) arranged to strike a said gong or radiant element (2), and wherein said flexible guide (10) comprises at least a second elastic strip in the vicinity of said striker (17).

11. The timepiece striking mechanism (100) according to claim 1, wherein said striking mechanism (100) comprises a striking mechanism barrel and/or an energy storage and distribution means, and wherein said hammer (3) comprises a first winding tooth (14) arranged to cooperate with an activation tooth (15) comprised by said activation mobile component (4) during the winding phase for pivoting said hammer (3), and a second anti-unhooking tooth (16) arranged to be inserted, at the end of winding and at least the start of letting down, between two further said activation teeth (15), so as to prevent any uncontrolled unwinding of said striking mechanism barrel and/or energy storage and distribution means.

12. The timepiece striking mechanism (100) according to claim 1, wherein said hammer (3) comprises at least one hammer magnet (23) or a ferromagnetic hammer element, arranged to cooperate with a ferromagnetic element of a mobile component or a magnet (24) of a mobile component, for the driving and release of said hammer (3) by said activation mobile component (4).

13. The timepiece striking mechanism (100) according to claim 1, wherein said hammer (3) is moved by a substantially rotary movement or a combination of rotary movements.

14. The timepiece striking mechanism (100) according to claim 1, wherein said hammer (3) is moved by a longitudinal movement.

15. The timepiece striking mechanism (100) according to claim 1, wherein said hammer (3) is moved by a longitudinal movement, and wherein said hammer (3) comprises a mobile frame (33) guided longitudinally in bearing blocks (34), said frame (33) comprising internally a chamber (35) wherein rest beaks (36) are arranged to cooperate with activation teeth (15) comprised by said activation mobile component (4).

16. The timepiece striking mechanism (100) according to claim 1, wherein said hammer (3) and the flexible guide(s) (10) supporting said hammer, as well as said gong or radiant element (2) with which said hammer (3) cooperates, are, in projection along said plane (P), symmetrical with respect to a plane perpendicular to said plane (P).

17. The timepiece striking mechanism (100) according to claim 1, wherein said striking mechanism (100) comprises, for the suspension of said hammer (3), a plurality of planar flexible guides (10), separate and at a distance from one another.

18. The timepiece striking mechanism (100) according to claim 1, wherein said striking mechanism (100) comprises a plurality of said hammers (3) and a plurality of said gongs or radiant elements (2).

19. The timepiece striking mechanism (100) according to claim 1, wherein said hammer (3) and one of said flexible guides (10) supporting the hammer form together a resonator arranged to regulate the striking mechanism.

20. A watch (1000) comprising energy storage and/or generation means (200) and a timepiece movement (300) arranged to drive a striking mechanism (100) according to claim 1.

* * * * *